US006657371B2

(12) United States Patent
Shin et al.

(10) Patent No.: US 6,657,371 B2
(45) Date of Patent: Dec. 2, 2003

(54) COLOR SELECTION APPARATUS FOR CATHODE RAY TUBE

(75) Inventors: Soon-Cheol Shin, Suwon (KR); Kuen-Dong Ha, Seoul (KR); Sang-Shin Choi, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 194 days.

(21) Appl. No.: 10/011,691

(22) Filed: Nov. 2, 2001

(65) Prior Publication Data

US 2002/0050778 A1 May 2, 2002

(30) Foreign Application Priority Data

Dec. 8, 2000 (KR) ..... 2000-74761

(51) Int. Cl.[7] ..... H01J 29/80; H01J 29/06
(52) U.S. Cl. ..... 313/407; 313/404; 313/402
(58) Field of Search ..... 313/402–407

(56) References Cited

U.S. PATENT DOCUMENTS 5,416,380 A 5/1995 Horiuchi ..... 313/407
5,550,428 A 8/1996 Kume et al. ..... 313/407

FOREIGN PATENT DOCUMENTS

KR 2002092511 A * 12/2002 ..... H01J/29/07

* cited by examiner

*Primary Examiner*—Ashok Patel
*Assistant Examiner*—Sikha Roy
(74) *Attorney, Agent, or Firm*—Christie, Parker & Hale, LLP

(57) ABSTRACT

A color selection apparatus includes a frame comprising a pair of supporting members disposed in parallel with each other and a pair of elastic members disposed between and coupled to the supporting members. Each of the elastic members is formed of a hollow tube. A mask is coupled to the supporting members while being applied with a predetermined tension, and exhaust openings are formed for exhausting remaining alien substances from within the elastic members during an assembling process of the color selection apparatus. The exhaust openings are formed on each of the elastic members at a portion adjacent to where the elastic members are coupled to the supporting members.

8 Claims, 5 Drawing Sheets

COLOR SELECTION APPARATUS FOR CATHODE RAY TUBE

CROSS REFERENCE TO RELATED APPLICATIONS

This application claims the benefit of Korean Application No. 200074761, filed on Dec. 8, 2000 in the Korean Patent Office, the entire disclosure of which is incorporated herein by reference.

FIELD OF THE INVENTION

The present invention relates to a color selection apparatus for a cathode ray tube (CRT), and more particularly, to a color selection apparatus that can be employed with a CRT having a flat screen panel.

BACKGROUND OF THE INVENTION

In recent years, a cathode ray tube having a flat panel on which a screen is formed has been developed as a display and widely used. That is, because users wish to see an image on a large-sized display, such as a color TV and a computer monitor, a screen panel of a CRT used for color TV's and computer monitor's has increased in size. As the size of the panel is increased, a technology for forming the panel to be flat has been developed in consideration of images realized at the peripheral region of the screen panel.

As the screen panel is enlarged and flattened, a color selection apparatus having a tension mask for realizing the color is also enlarged. However, when the color selection apparatus is enlarged, a variety of problems, including a rigidity problem, occur. Therefore, new designs of the color selection apparatus have been employed.

Namely, a tension mask having a plurality of apertures through which electron beams pass is designed to be flat rather than formed having a curvature radius. The tension mask is applied with a predetermined tension. A color selection apparatus having such a flat tension mask is disclosed in U.S. Pat. Nos. 5,416,380 and 5,550,428. FIG. 6 shows a conventional color selection apparatus having such a flat tension mask. As shown in the drawing, a color selection apparatus comprises a pair of elastic members 2 and 4, a pair of supporting members 6 and 8 respectively coupled to the elastic members 2 and 4, and a flat mask 10 supported by the supporting members 6 and 8 and provided with a plurality of electron beam passing apertures 10*a*.

Each of the elastic members 2 and 4 are spaced away from each other and are formed in a U-shape using a hollow tube member. The supporting members 6 and 8 are arranged in parallel in a longitudinal direction of the mask 10. Opposite ends of each of the supporting members 6 and 8 are respectively fixed on ends of the respective elastic members 2 and 4 using a welding process.

The flat mask 10 is welded on the supporting members 6 and 8, and it maintains its predetermined tension according to the movement of the elastic members 2 and 4.

The above-described color selection apparatus is mounted inside the panel of the CRT so as to select a color when electron beams are radiated from an electron gun.

A hole 2*a* is formed passing through each side of the elastic members 2 and 4. The holes 2*a* are covered with a steel plate 12 having a predetermined thickness. During the welding process for coupling the elastic members 2 and 4 to the supporting members 6 and 8, a welding gas may flow into the hollow-shaped elastic members 2 and 4. The holes 2*a* function as a gas exhaust hole for exhausting such a gas out of the elastic members 2 and 4.

The holes 2*a* are temporally blocked by, for example, nails, during the assembling process of the color selection apparatus after the welding process. The holes 2*a* are then permanently blocked by the steel plate 12 after the assembling process.

The temporary blocking of the holes 2*a,* using, for example, nails, is to prevent cleansing agents from flowing into the elastic members 2 and 4 through the holes during the cleansing process of the color selection apparatus. Since the hollow elastic members 2 and 4 are sealed when they are coupled to the supporting members 6 and 8, if the cleansing agent flows into the elastic members 2 and 4 and the hole 2*a* is too small, the cleansing agent may not be completely drained out of the elastic members 2 and 4.

In addition, the permanent blocking of the elastic members 2 and 4 using the steel plates 12 after the assembling process is to prevent alien substances, such as iron filings and dust, remaining in the hollow elastic members 2 and 4 from getting out during the exhaust process of the CRT where the color selection apparatus is mounted. If the alien substances get out of the elastic members 2 and 4, the alien substances may block the electron beam passing holes or be attached to the electron gun, thereby deteriorating the performance of the CRT.

As described above, due to the structure of the color selection apparatus, the CRT is manufactured through many processes to improve its performance. Therefore, many apparatuses for each process are required. This causes a deterioration of productivity and an increase in manufacturing costs. Therefore, there is a need for an improved structure of a color selection apparatus that can simplify the manufacturing process of a CRT, thereby improving productivity and reducing manufacturing costs.

SUMMARY OF THE INVENTION

To meet the above need, the present invention provides a color selection apparatus with a frame having a pair of supporting members disposed in parallel with each other, and a pair of elastic members disposed between, and coupled to, the supporting members. Each of the elastic members is formed of a hollow tube. A mask is coupled to the supporting members while being applied with a predetermined tension. The color selection apparatus also has a means for exhausting remaining alien substances from within the elastic members during an assembling process of the color selection apparatus, the means for exhausting being formed on each of the elastic members at a portion adjacent to where the elastic members are coupled to the supporting members.

According to a first embodiment of the present invention, the means for exhausting comprises a cut-away portion formed such that an inside of each elastic member is opened to an outside.

According to a second embodiment of the present invention, the means for exhausting comprises opened opposite ends of each elastic member, a part of each of the opened opposite ends maintaining its open state even after the opened opposite ends are coupled to the supporting members.

BRIEF DESCRIPTION OF THE DRAWINGS

The accompanying drawings, which are incorporated in and constitute a part of the specification, illustrate embodiments of the invention, and, together with the description, serve to explain the principles of the invention.

DETAILED DESCRIPTION OF THE PREFERRED EMBODIMENTS

Preferred embodiments of the present invention will be described in detail with reference to the accompanying drawings.

Figure 1:
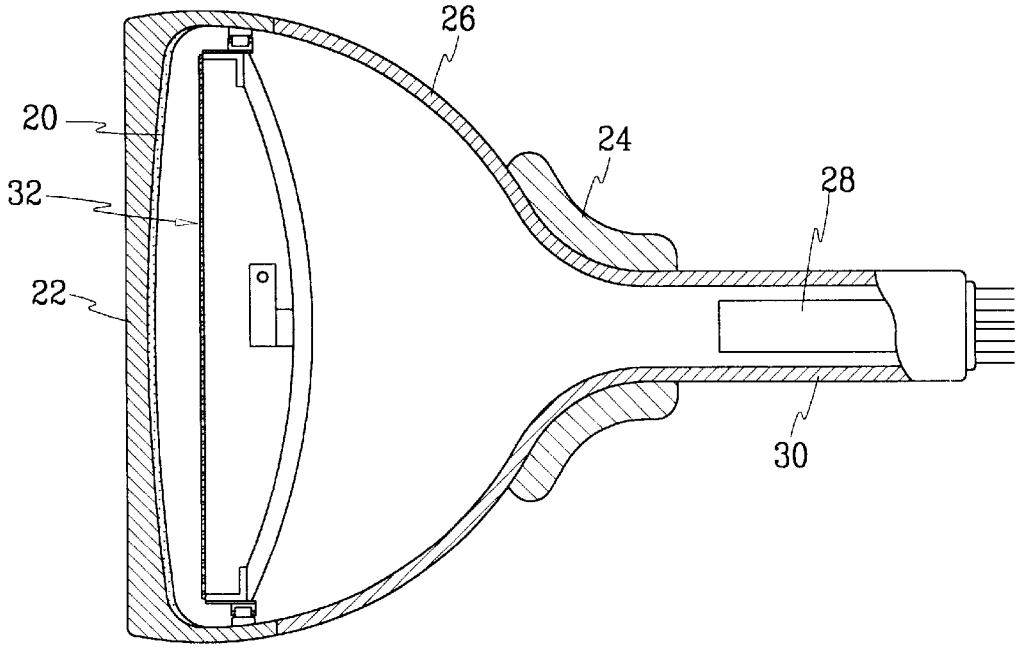
FIG. 1 is a side sectional view of a CRT where a color selection apparatus according to the present invention may be employed.

FIG. 1 shows a CRT where a color selection apparatus according to the present invention may be employed. A CRT comprises a panel 22, on an interior front surface of which a phosphor screen 20 is formed. A funnel 26 is connected to the panel 22, and a neck 30 is connected to the funnel 22. A deflection yoke 24 for deflecting electron beams is mounted around the funnel 22 and an electron gun 28 for radiating electron beams is disposed in the neck 30.

As shown in FIG. 1, an exterior front surface of the panel 22 is formed to be flat, while the interior front surface thereof is formed having a curvature radius. A color selection apparatus 32 is disposed inside the panel so as to perform the color selection of the electron beams radiated from the electron gun 28.

Figure 2A:
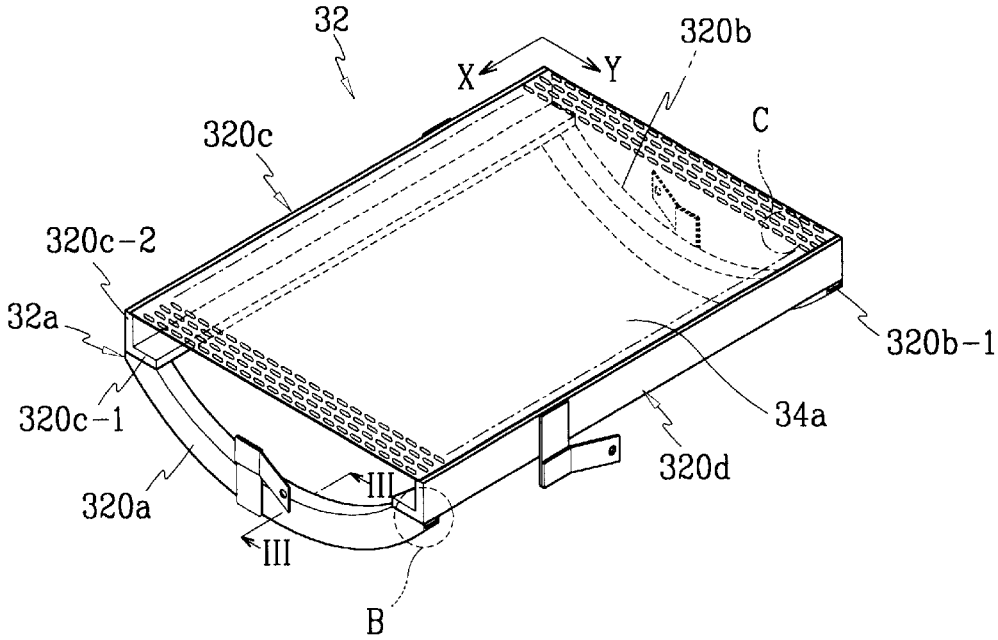
FIG. 2A is a perspective view of a color selection apparatus according to a first embodiment of the present invention.
Figure 2B:
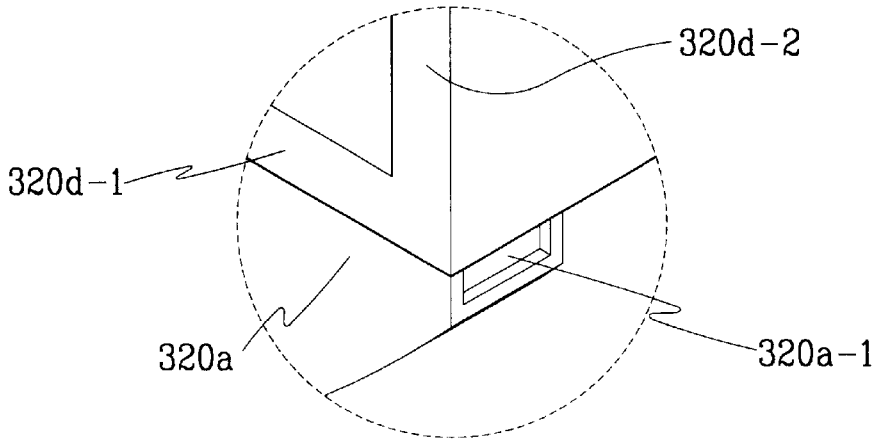
FIG. 2B is an enlarged view of the circled portion B of FIG. 2A.
Figure 2C:
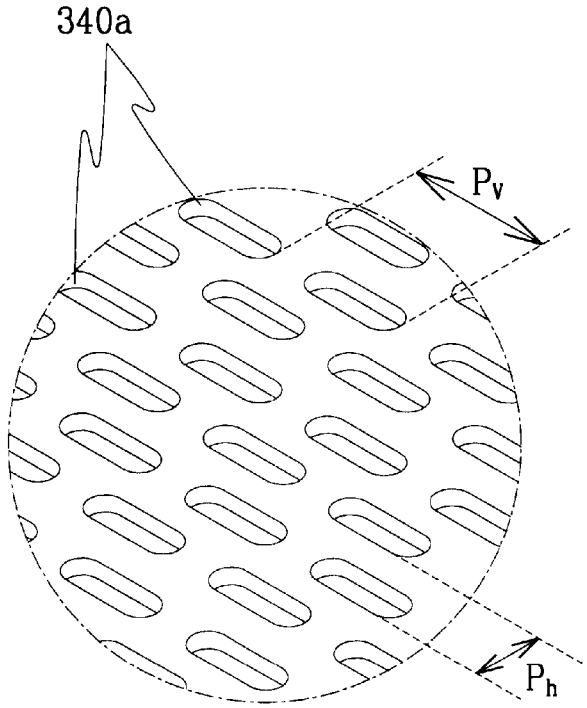
FIG. 2C is an enlarged view of the circled portion C of FIG. 2A.

FIGS. 2A to 2C show a color selection apparatus according to a first embodiment of the present invention. The color selection apparatus 32 has a frame 32*a* having a pair of elastic members 320*a* and 320*b* and a pair of supporting members 320*c* and 320*d* coupled to the elastic members 320*a* and 320*b*. The color selection apparatus 32 also has a mask 34*a* coupled to the frame 32*a* while being applied with a predetermined tension. The elastic members 320*a* and 320*b* are disposed facing each other at a predetermined distance, and are coupled to the supporting members 320*c* and 320*d*.

Figure 3:
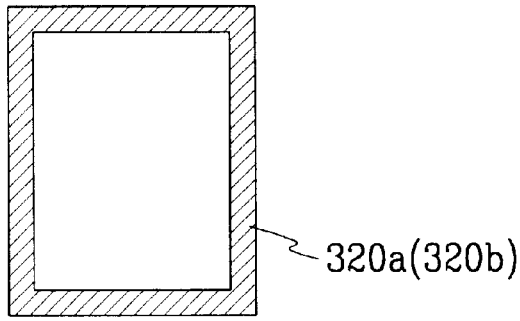
FIG. 3 is a sectional view taken along the line III—III of FIG. 2A.
Figure 4:
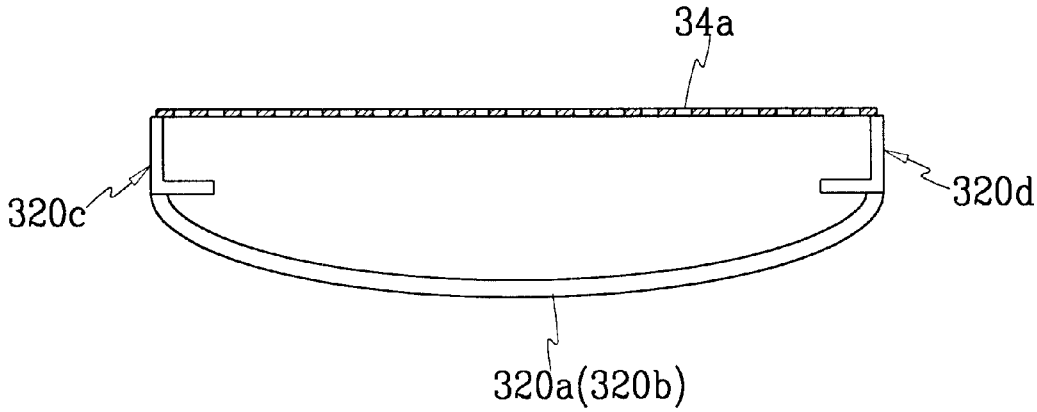
FIG. 4 is a view illustrating an elastic member according to a preferred embodiment of the present invention.

As shown in FIG. 3, each of the elastic members 320*a* and 320*b* is formed of a hollow tube having a square cross-section. The elastic members 320*a* and 320*b* are curved in their longitudinal direction. That is, the elastic members 320*a* and 320*b* may be formed in an arc-shape, as shown in FIG. 2A, or in a semi-oval shape, as shown in FIG. 4. The cross-section of the elastic members 320*a* and 320*b* is not limited to the square shape. For example, the cross-section of the elastic member may also be formed in a circular shape.

The supporting members 320*c* and 320*d* are disposed in parallel with a longitudinal axis X of the panel 22 between the elastic members 320*a* and 320*b*. That is, opposite ends of the elastic member 320*a* are respectively welded on ends of the supporting members 320*c* and 320*d*, and opposite ends of the elastic member 320*b* are respectively welded on the other ends of the supporting members 320*c* and 320*d*.

Each of the supporting members 320*c* and 320*d* comprise a first plate 320*c*-1 and 320*d*-1 coupled to the elastic members 320*a* and 320*b* and a second plate 320*c*-2 and 320*d*-2 extending from the first plate 320*c*-1 and 320*d*-1 at an angle of about 90 degrees and coupled to a mask 34*a*.

The mask 34*a* thereby connected to the elastic members 320*a* and 320*b* via the supporting members 320*c* and 320*d* is formed to be flat. The mask 34*a* is welded on the second plates 320*c*-2 and 320*d*-2 in a state such that it is applied with a tension along a lateral axis Y of the panel 22. At this point, as shown in FIG. 2C, each of the beam passing apertures 340*a* is elongated in the lateral axis Y direction of the panel 22 such that it is has a vertical pitch Pv and a horizontal pitch Ph.

In addition, means for exhausting alien substances, including gas, cleansing agents, dust, and iron filings, which are generated during the manufacturing process of the color selection apparatus 32, out of the elastic members 320*a* and 320*b*, is formed on the elastic members 320*a* and 320*b*.

In a first embodiment of the present invention, as shown in FIGS. 2A and 2B, cut-away portions 320*a*-1 and 320*b*-1 are formed on at least one end of each of the elastic members 320*a* and 320*b*. The cut away portions 320*a*-1 and 320*b*-1 are adjacent to the portion of the elastic members 320*a* and 320*b* for coupling to the supporting member 320*d*.

Accordingly, the gas generated during the welding process for coupling the elastic members 320*a* and 320*b* to the supporting members 320*c* and 320*d* can be easily exhausted out of the elastic members 320*a* and 320*b* through the cut-away portions 320*a*-1 and 320*b*-1.

In addition, the cut-away portions 320*a*-1 and 320*b*-1 are designed to be large enough that the cleansing agent introduced into the elastic members 320*a* and 320*b* during the cleansing process of the color selection apparatus 32, as well as other alien substances such as dust and iron filings, can also be easily removed from the elastic members 320*a* and 320*b* therethrough. The cut-away portions 320*a*-1 and 320*b*-1 are not blocked even after the assembling process of the color selection apparatus 32.

As described above, because the cut-way portions 320*a*-1 and 320*b*-1 are formed to be large enough on the elastic members, alien substances can be easily exhausted out of the elastic members. Therefore, no temporary blocking process or permanent blocking process is required in this invention, thereby improving productivity and reducing manufacturing costs.

Figure 5:
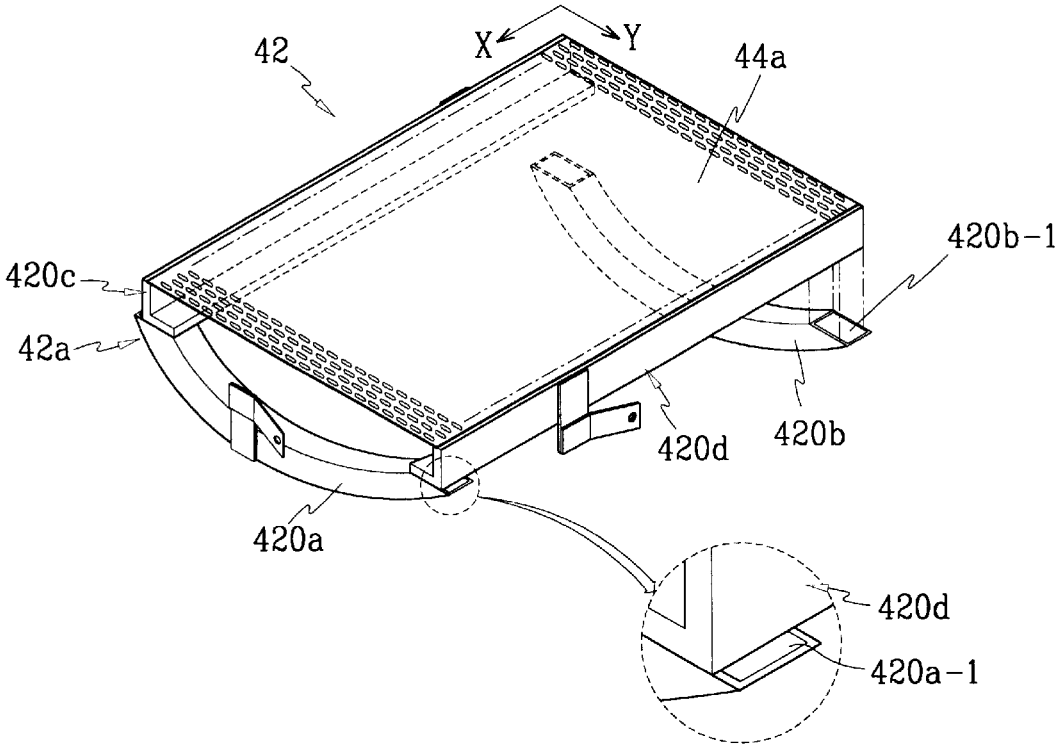
FIG. 5 is a perspective view of a color selection apparatus according to a second embodiment of the present invention.
Figure 6:
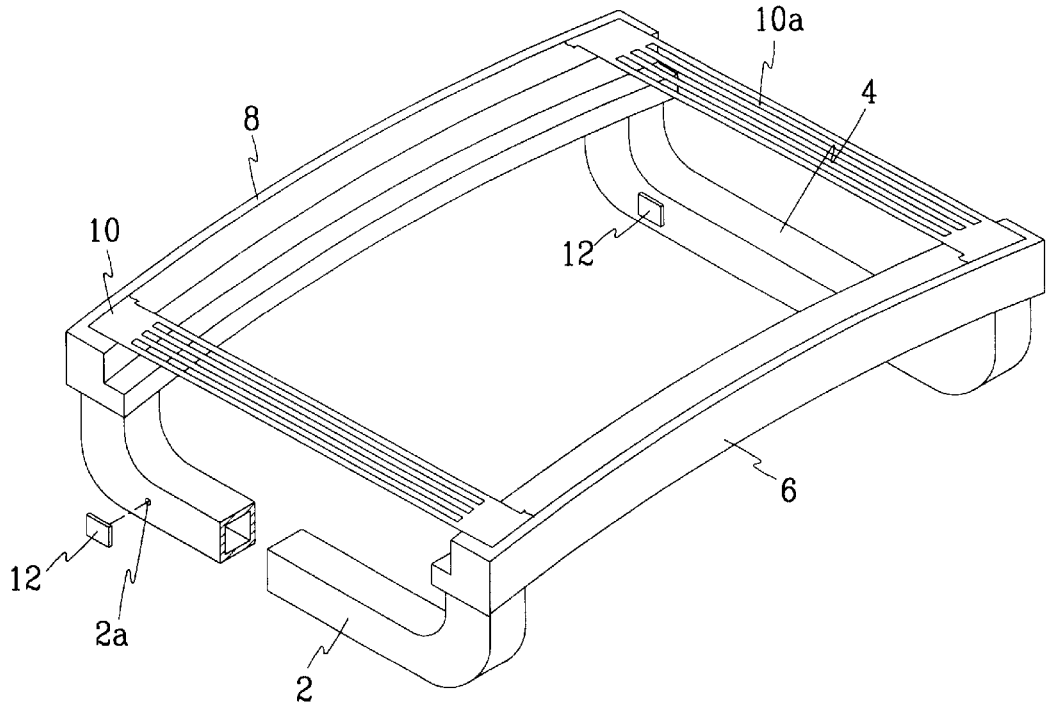
FIG.6(Prior Art)
FIG. 6 is a perspective view of a conventional color selection apparatus.

FIG. 5 shows a color selection apparatus according to a second embodiment of the present invention. A color selection apparatus 42 of this embodiment has a frame 42*a* having a pair of elastic members 420*a* and 420*b* and a pair of supporting members 420*c* and 420*d*. A mask 44*a* is coupled to the frame 42*a* while being applied with a predetermined tension. The color selection apparatus 42 of this embodiment also has a means for exhausting alien substances out of the elastic members 420*a* and 420*b*. Since the basic structure of the color selection apparatus of this embodiment is identical to that of the first embodiment, the detailed description thereof will be omitted herein except for the means for exhausting the alien substances.

The means for exhausting the alien substances according to this embodiment comprises opening ends 420*a*-1 and 420*b*-1 formed on opposite ends of each of the elastic members 420*a* and 420*b*. Each of the hollow tubes forming the elastic members 420*a* and 420*b* has opposite opening ends 420*a*-1 and 420*b*-1.

Portions of the opening ends 420*a*-1 and 420*b*-1 maintain their open states even when the elastic members 420*a* and 420*b* are welded to the supporting members 420*c* and 420*d* at the opening ends 420*a*-1 and 420*b*-1. The open portions of the opening ends 420*a*-1 and 420*b*-1 function as the means for exhausting the alien substances including gas, cleansing agents, dust and iron filings.

Although preferred embodiments of the present invention have been described in detail hereinabove, it should be clearly understood that many variations and/or modifications of the basic inventive concepts taught herein that may appear to those skilled in the present art will still fall within the spirit and scope of the present invention, as defined in the appended claims.

What is claimed is:

1. A color selection apparatus comprising:

a frame having a pair of supporting members disposed in parallel with each other and a pair of elastic members disposed between and coupled to the supporting members, each of the elastic members being formed of a hollow tube;

a mask coupled to the supporting members while being applied with a predetermined tension; and an exhaust for exhausting alien substances from within the elastic members during an assembling process of the color selection apparatus, the exhaust being formed on each of the elastic members at a portion adjacent to where the elastic members are coupled to the supporting members.

2. The color selection apparatus of claim 1 wherein the exhaust comprises a cut-away portion of each of the elastic members formed such that an inside of each elastic member is opened to an outside.

3. The color selection apparatus of claim 1 wherein the exhaust comprises opened opposite ends of each elastic member, a part of each of the opened opposite ends maintaining its open state even after each of the elastic elements are coupled to the supporting members.

4. The color selection apparatus of claim 1 wherein a lateral section of each of the elastic members has a square shape.

5. The color selection apparatus of claim 1 wherein each of the elastic members is formed having a predetermined curvature radius in a longitudinal direction.

6. The color selection apparatus of claim 5 wherein each of the elastic members is formed in an arc shape in the longitudinal direction.

7. The color selection apparatus of claim 5 wherein each of the elastic members is formed in a semi-oval shape in the longitudinal direction.

8. The color selection apparatus of claim 5 wherein each of the supporting members comprises a first plate coupled to the elastic members and a second plate extending from the first plate at a predetermined angle, the second plate being coupled to the mask.

* * * * *